US005347498A

United States Patent [19]

Loth et al.

[11] Patent Number: 5,347,498

[45] Date of Patent: Sep. 13, 1994

[54] WATCH BRACELET

[75] Inventors: Eric Loth, Bienne; Joseph Fray, Glovelier, both of Switzerland

[73] Assignee: Montres Rado S.A., Biel, Switzerland

[21] Appl. No.: 118,620

[22] Filed: Sep. 10, 1993

[30] Foreign Application Priority Data

Sep. 11, 1992 [FR] France ..... 92 10946

[51] Int. Cl.[5] ..... G04B 37/00; F16G 13/18; A44C 5/02

[52] U.S. Cl. ..... 368/282; 59/80; 59/84; 63/3; 224/173

[58] Field of Search ..... 368/281–282; 59/78, 80, 84, 90; 63/3, 4, 5.1, 7; 224/173, 175

[56] References Cited

U.S. PATENT DOCUMENTS 1,658,381 2/1928 Kilstrom .
1,735,384 11/1929 Fielding .
1,906,570 5/1933 Gilbert et al. .
2,858,665 11/1958 Vastano .
3,449,906 6/1969 King .
4,051,668 10/1977 Learn ..... 59/80
4,740,935 4/1988 Gogniat ..... 368/294
4,770,008 9/1988 Yamaura ..... 63/3
4,930,304 6/1990 Meister ..... 59/80

FOREIGN PATENT DOCUMENTS 0081464 6/1983 European Pat. Off. .
8904193 5/1989 Fed. Rep. of Germany .
1418802 12/1975 United Kingdom .

*Primary Examiner*—Vit W. Miska
*Attorney, Agent, or Firm*—Griffin, Butler, Whisenhunt & Kurtossy

[57] ABSTRACT

The links, which are hinged together constituting the bracelet, comprise a core (2) formed from machinable metal and provided with hinges (14), sandwiched between two protection parts (4, 6). The protection parts are maintained in place by at least one stud (10) fixed to one of the protection parts (6) and extending through piercings (12, 13) formed respectively in the core (2) and in the other protection part (4), the stud (10) being retained in said piercings by a swaged rivet head at its distal end (10*a*). Two lateral portions (8) of one of the protection parts (6) extend opposite the lateral faces of the link.

7 Claims, 2 Drawing Sheets

WATCH BRACELET

The invention concerns a link bracelet, in particular for a watch, and more specifically a bracelet with links the visible portions of which are formed of decorative elements of hard material which cover over the link cores of machinable material and which are fixed to such link cores.

BACKGROUND OF THE INVENTION

The patent document EP 0 081 464 A1 has already described a metallic bracelet formed of links hinged together the visible portions of which are constituted of decorative pieces in precious metal. Such decorative pieces cover over a core made up of plates linked together with the help of hinges.

According to this prior document, the decorative pieces are fixed to the main faces of the hinged plates by welding. Such fastening method presents difficulties, however. In particular, if the elements to be fixed onto the metallic core are of sintered hard metal or of ceramic, the welding provokes the appearance in the assembly of unacceptable mechanical stresses. Such stresses are due to the difference between the coefficient of thermal expansion of the hard material and of the machinable metal making up the core.

The patent document EP 0 015 242 B1 also describes a bracelet formed of links of which one of the faces is covered over by a thin protection part of sintered hard metal. The fastening of such protection part onto the body of the link is assured by two studs welded against one face of the protection part and which are retained by swaged rivet heads in holes traversing the body of the link.

According to this latter document, there is no part covering over the inner faces of the links. Consequently, when the bracelet is worn on the wrist, the hinged base body of the latter is found to be directly in contact with the arm of the user. Under such conditions, it is imperative that the bracelet core exhibit an inner surface which is quite smooth. In particular the hinges which form the bracelet links must not constitute projecting portions going beyond the inner surface of the bracelet between the link cores.

The dimension of the hinges of a link bracelet being incapable of reduction beyond a certain point without compromising the strength of the latter, the link cores must show a considerable thickness. It is for this reason that the links shown on the figures of the patent document EP-0 015 242 B1 are of relatively complex form. The obtaining of such thick links is relatively burdensome.

Bracelets obtained according to the document hereinabove further show the drawback of not including protection for the lateral portions of the links, the latter thus risking damage by a shock. Additionally, the link cores being partially visible and having a tint and texture different from that of the protection parts, the bracelet described cannot have the aspect of a bracelet the links of which are formed in one piece.

The German document DGM 8 904 193 describes a bracelet link the visible portions of which are entirely covered over by protection parts and which can thus present the appearance of a link formed in a single piece. Such bracelet link comprises initially a first protection part having substantially the form of a rectangular plate the upper face of which includes, proximate each of its ends, a raised zone constituting a shoulder and which forms a base on which studs are further secured. A link core constituted by a plate provided with hinges rests on such first protection part and said studs are engaged in piercings in the link core in order to assure the orientation. A second protection part forming a cap is driven onto the two shoulders of the first protection part. Such cap covers over and hides the link core as well as the two shoulders. We note that the cap, being driven onto the shoulders formed on the upper face of the base, its edges do not cover over the lateral faces of such first protection part. Such lateral faces thus remain visible when the bracelet is worn on the wrist.

This latter embodiment is furthermore unsuitable when the protection parts are of sintered hard metal. Effectively, elastic deformations cannot be required of a piece of sintered hard metal. In order to permit the cap to be held solidly secured onto the base by driving, it is thus necessary to produce parts which are dimensioned in an extremely precise manner. Since the parts shrink more than considerably in the course of sintering, it is necessary to have recourse to a subsequent machining which is extremely laborious.

SUMMARY OF THE INVENTION

The purpose of the present invention is to overcome the drawbacks of the prior art in providing a bracelet formed of links which are hinged together and which include an inner face, an outer face and two lateral faces, said links comprising a link core provided with hinges, a first and a second protection part and means for securing said protection parts onto said link core, said bracelet being characterized in that said first protection part covers over entirely the inner face of said link core, in that said second protection part comprises a central portion which covers over entirely the outer face of said link core and two lateral portions which cover over the lateral faces of the link core and of the first protection part and in that said securing means comprise at least one stud fixed to said second protection part, said stud extending through piercings effected respectively in said link core and in said first protection part and being retained in said piercings by a swaged rivet head on its distal end.

To clarify the description, it is useful to specify what is understood by the inner face, outer face and lateral face.

A bracelet forms a substantially circular band surrounding an arm. By inner face of a link, there is understood thus the face of the link which is in contact with the arm and by outer face of a link, the face of the latter which is opposite the inner face. Finally, by lateral face of a link, there is understood the faces of the latter which are substantially parallel to the plane of symmetry of the bracelet which cuts the links in half.

An advantage of the present invention consists in that the visible portions of the link are entirely covered over by protection parts which can be of forms easy to obtain in sintered hard metal or in ceramic.

Another advantage of the present invention consists in that the link cores can be of a simple form easy to machine since their inner faces are also covered over by protection parts and consequently their form does not determine the form of the inner surface of the bracelet.

Another advantage of the present invention resides in the fact that the two lateral portions of the second protection part cover over the lateral faces of the first protection part, the latter thus not being visible when the bracelet is worn on the wrist. The present invention thus permits, should it be so desired, to obtain the first protection part from an easily machinable metal, only the second protection part being then always formed of hard material.

Finally, the securing by a rivet is easy to practise and does not require extreme precision during machining of the parts.

Conforming to a preferred characteristic of the invention, the securing means of the protection parts on the link core comprise a single riveted stud which holds the pieces together. The pieces are, on the other hand, prevented from turning relative to one another by the presence of the lateral portions of the second protection part which extend facing the lateral faces of the two other elements.

Other characteristics and advantages of the invention will appear in the course of the description to follow given solely by way of example and made having reference to the attached drawings.

DESCRIPTION OF THE PREFERRED EMBODIMENT

Figure 1:
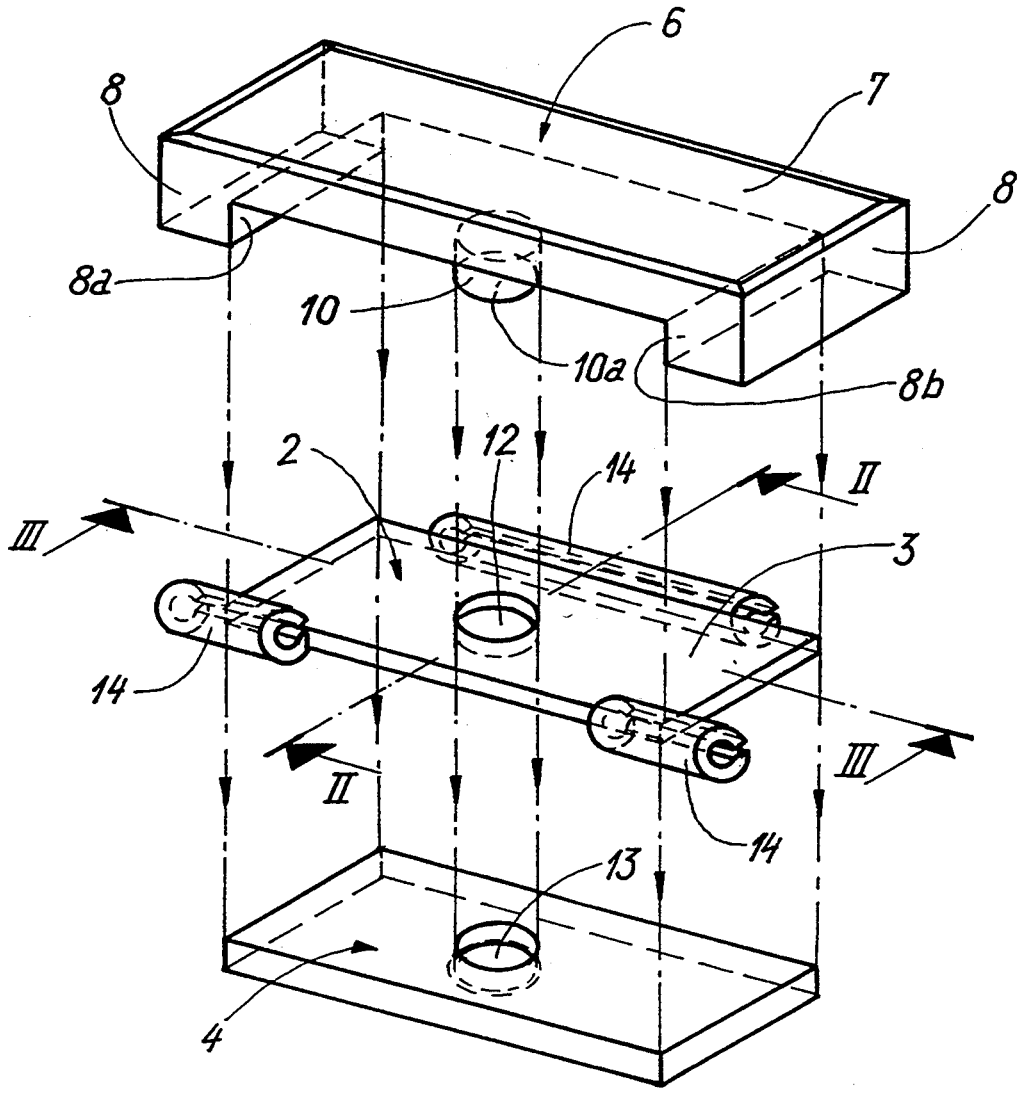
FIG. 1 is an exploded perspective view of the parts making up a bracelet link according to the invention.
Figure 2:
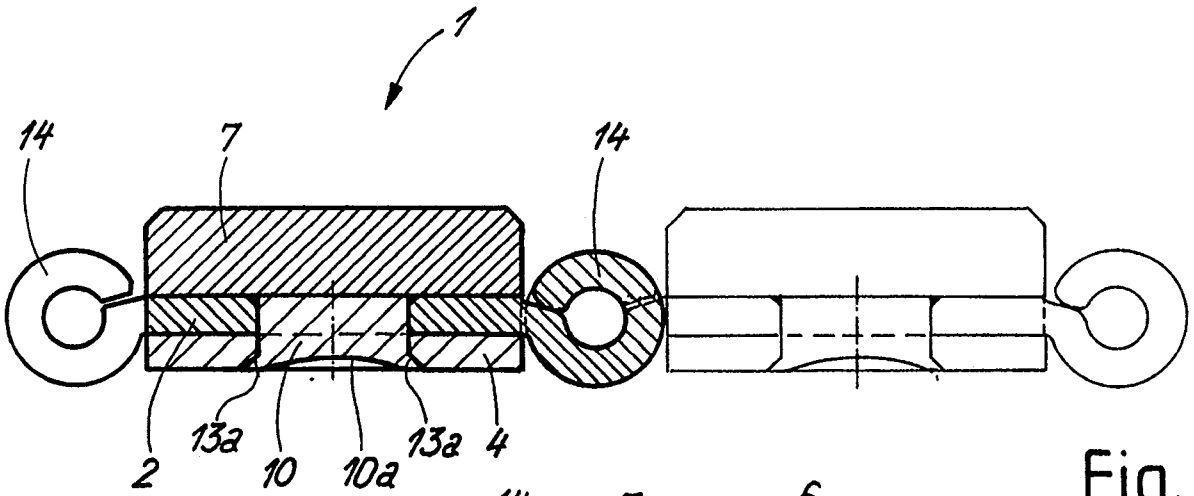
FIGS. 2 and 3 are cross-sectional views of such link.
Figure 3:
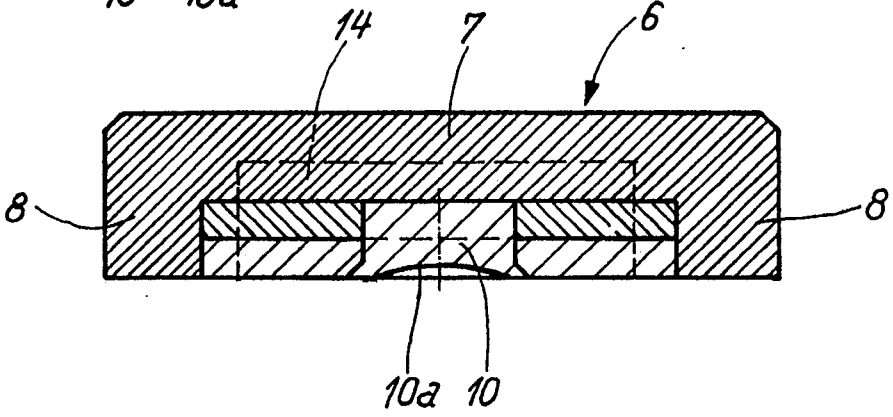

Link 1 is formed by a link core 2 of machinable metal and of two protection parts 4, 6, at least one of such protection parts 6 being formed of hard material.

The link core 2 is constituted of a plate 3 and of hinge parts 14 integral with such plate. It is formed preferably by stamping from a sheet of steel, the ends of the sheet being thereafter rolled in order to form the hinge parts 14.

The protection parts 4, 6 are, as we have already said, preferably formed of sintered hard metal or of ceramic.

The first protection part 4 is shaped in order to cover over entirely the inner face of plate 3 of the link core 2. The second protection part 6 comprises a central portion 7 which covers over entirely the outer face of plate 3 and two lateral portions 8 which extend facing the lateral faces of the link core 2 and of the first protection part. The thickness of the second protection part 6 at the level of the two lateral portions 8 is substantially equal to its thickness at the level of the central portion 7 added to the thickness of the first protection part 4 and that of the plate 3 of the link core 2. Consequently, when the elements are assembled, the surface of the first protection part is flush between the two shoulders 8*a* and 8*b* formed by the lateral portions 8 of the second protection part 6 and from this fact, the inner surface of the link is substantially planar. The lateral faces of the link core 2 and of the first protection piece 4 being furthermore entirely hidden by the lateral portions 8 of the second protection part 6, the link gives the aspect of an element formed as a single piece.

The link 1 is maintained assembled by a stud 10 of deformable metal fixed to the second protection part 6. Such stud is preferably formed by a cylinder of steel or brass which is welded by one of its ends onto the central portion 7 of the second protection part 6. The stud 10 passes through piercings 12, 13 formed respectively in the link core 2 and in the first protection part 4 and it is retained in the latter by swage riveting of its end 10*a* in a countersink 13*a* of said first protection part.

The presence of shoulders 8*a*, 8*b* of the second protection part 6 prevents any rotation of such part around the axis of stud 10.

What we claim is:

1. A bracelet formed of links which are hinged together and which include an inner face, an outer face and two lateral faces, said links comprising a link core provided with hinges, a first and a second protection part and means for securing said protection parts onto said link core, said first protection part covering over entirely the inner face of said link core, said second protection part comprising a central portion which covers over entirely the outer face of said link core and two lateral portions which cover over the lateral faces of the link core and of the first protection part and said securing means comprising at least one stud fixed to said second protection part, said stud extending through piercings effected respectively in said link core and in said first protection part and being retained in said piercings by a swaged rivet head on its distal end.

2. A bracelet formed of links which are hinged together as set forth in claim 1, wherein said stud is fixed to said second protection part by welding.

3. A bracelet formed of links which are hinged together as set forth in claim 1, wherein the thickness of said second protection part in said lateral portions thereof is substantially equal to the sum of the respective thicknesses of said central portion, said link core and said first protection part.

4. A bracelet formed of links which are hinged together as set forth in claim 1, wherein said second protection part is formed from sintered hard metal.

5. A bracelet formed of links which are hinged together as set forth in claim 4, wherein said first protection part is formed from sintered hard metal.

6. A bracelet formed of links which are hinged together as set forth in claim 1, wherein said second protection part is formed from ceramic.

7. A bracelet formed of links which are hinged together as set forth in claim 6, wherein said first protection part is formed from ceramic.

* * * * *